US006406591B1

(12) United States Patent
Beckstrom et al.

(10) Patent No.: US 6,406,591 B1
(45) Date of Patent: Jun. 18, 2002

(54) MAILING MACHINE INCLUDING A STRIPPER BLADE HAVING A RAISE EDGE

(75) Inventors: David W. Beckstrom, Fairfield; Patrick T. Thrailkill, New Haven, both of CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/364,079

(22) Filed: Jul. 30, 1999

(51) Int. Cl.[7] ..... B43M 3/00; B05C 11/105

(52) U.S. Cl. ..... 156/441.5; 156/442.4; 156/578; 118/268; 53/381.7

(58) Field of Search ..... 156/441.5, 442.2, 156/442.4, 578; 53/381.5, 38.7; 118/32, 268

(56) References Cited

U.S. PATENT DOCUMENTS

| | | | | | |
|---|---|---|---|---|---|
| 3,859,955 | A | | 1/1975 | Labore | 118/32 |
| 4,450,037 | A | | 5/1984 | Gavronsky | 156/441.5 |
| 4,551,188 | A | * | 11/1985 | Schulze | 156/441.5 |
| 4,643,123 | A | | 2/1987 | Auerbach | 118/32 |
| 4,775,143 | A | | 10/1988 | Arnoldi et al. | 271/251 |
| 4,903,633 | A | | 2/1990 | Nobile et al. | 118/268 |
| 4,926,787 | A | | 5/1990 | Fassman et al. | 118/32 |
| 4,971,686 | A | | 11/1990 | O'Des et al. | 209/548 |
| 5,006,194 | A | | 4/1991 | Schmaling | 156/442.1 |
| 5,022,953 | A | | 6/1991 | Fassman et al. | 156/441.5 |
| 5,138,816 | A | * | 8/1992 | Holbrook et al. | 53/381.7 |
| 5,209,806 | A | * | 5/1993 | Hibberd | 156/441.5 |
| 5,385,627 | A | | 1/1995 | Weimer | 156/441.5 |
| 5,489,358 | A | * | 2/1996 | Miciukiewicz | 156/366 |
| 5,569,327 | A | | 10/1996 | Paradis et al. | 118/253 |
| 5,746,881 | A | | 5/1998 | Jenkins et al. | 156/578 |

* cited by examiner

*Primary Examiner*—Richard Crispino
*Assistant Examiner*—Sue A. Purvis
(74) *Attorney, Agent, or Firm*—Angelo N. Chaclas; Charles R. Malandra, Jr.

(57) ABSTRACT

A mailing machine including a base, a registration wall and a stripper blade. The base includes a deck defining a deck plane along which an envelope having an envelope body, an envelope flap and a top edge may be fed in a path of travel. The registration wall is located substantially perpendicular to the deck and parallel to the path of travel and along which the envelope top edge may be aligned during feeding. The stripper blade is located upstream in the path of travel from the deck, the stripper blade including a knife edge that is raised above the deck plane for separating the envelope flap from the envelope body.

8 Claims, 10 Drawing Sheets

MAILING MACHINE INCLUDING A STRIPPER BLADE HAVING A RAISE EDGE

FIELD OF THE INVENTION

This invention relates to mailing machines including a moistener assembly for wetting a gummed flap of an envelope. More particularly, this invention is directed to a stripper blade of the moistener assembly for separating the flap from a body of the envelope.

BACKGROUND OF THE INVENTION

Mailing machines for processing envelopes are well known in the art. Various mailing machines are readily available from manufacturers such as Pitney Bowes Inc. of Stamford, Conn., USA and often include a variety of different modules, which automate the processes of producing envelopes. The typical mailing machine includes a variety of different modules or sub-systems where each module performs a different task on an envelope, such as: singulating (separating the envelopes one at a time from a stack of envelopes), weighing, moistening/sealing (wetting and closing the glued flap of an envelope), applying evidence of postage, accounting for postage used (performed by the postage meter), feeding roll tape or cut tape strips for printing and stacking finished envelopes. However, the exact configuration of each mailing machine is particular to the needs of the user. Customarily, the mailing machine also includes a transport apparatus, which feeds the envelopes in a path of travel through the successive modules of the mailing machine.

Generally, mailing machines are constructed depending upon the throughput characteristics, measured in a number of envelopes processed per minute, desired by the customer. To meet such diverse requirements, a wide range of mailing machines are commonly available. High throughput mailing machines tend to automate more of the envelope handling activities than low throughput mailing machines. As a result, mailing machines tend to be either hand fed or machine fed. In hand fed mailing machines, an operator places a single envelope along a feed deck until the envelope activates a trip switch and is engaged by the transport apparatus. In contrast, in machine fed mailing machines, the operator places a stack of envelopes on the feed deck and a pre-feed mechanism advances the stack into engagement with a singulator that separates the envelopes and delivers them seriatim (one at a time) to the transport apparatus.

Oftentimes, the moistener module is located within the mailing machine that is outside the control of the operator. In machine fed mailing machines, the moistener module is located downstream in the path of travel from the singulator because the flap of the envelope cannot be separated from the body of the envelope, wetted and sealed while the envelope is in the stack. Several examples of moistener modules that are located downstream of the singulator are shown in U.S. Pat. Nos. 4,971,686 and 5,138,816. In some hand fed mailing machines, such as those of U.S. Pat. Nos. 3,859,955, 4,450,037, 4,643,123, 4,775,143, 5,006,194 and 5,569,327, the moistener module is located downstream from the nip of the transport apparatus. As a result, the moistener module of both of these types of mailing machines is completely automated and operator intervention in this area is not allowed. Although such systems work generally well, they are very complex, costly to produce and do not handle a full spectrum of envelope shapes/sizes and flap profiles.

Hand fed mailing machines where the moistening/sealing function is not fully automated also exist. In U.S. Pat. No. 5,385,627, two feed paths are provided for. If the operator wants to seal the envelope (24), then it is hand feed along deck (18) so that the top edge (62) of the envelope is registered up against the fence (60) and the envelope passes underneath guide (136) so as to come into contact with the flap deflecting structure (80) before reaching the impression roller (70). On the other hand, if the operator does not want to seal the envelope (24), then it is hand feed along the top of the guide (136) so as to bypass the flap deflecting structure (80). Although this system works generally well, it suffers from various disadvantages. First, it requires considerable dexterity and skill on the part of the operator. The operator must select the correct path and then both advance and maintain proper registration of the envelope. Second, this arrangement does not provide the operator with tactile feedback that the flap has been separated properly. Third, at least one of the paths bends the envelope considerably increasing the risk of damage to the contents of the envelope and drag which requires greater motor torque to move the envelope through the machine.

U.S. Pat. Nos. 4,903,633, 4,926,787, 5,022,953 and 5,746,881 show another type of hand fed mailing machine where the moistening/sealing function is not fully automated. In these systems, to effect sealing the operator is required to manually separate the flap (72) from the body of the envelope (20) and place the flap in the gap 100 between the fence (50) and the deck (14A). On positioned in this manner, the envelope is advanced along the deck while maintaining the envelope's top edge (52) against the fence. If no sealing is required, then the flap is not placed in the gap and the envelope is fed along the deck. Although this system has one fed path, it still suffers from various disadvantages. Here again, it requires considerable dexterity and skill on the part of the operator. The operator must simultaneously separate the flap, align the top edge with the fence and advance the envelope. Also, this technique is not intuitive and therefore inexperienced operators have difficulty producing properly sealed envelopes.

Therefore, there is a need for a cost effective hand fed mailing machine including a moistener assembly that is easier for operators to use and provides greater tactile feedback so that envelopes are properly sealed.

SUMMARY OF THE INVENTION

Accordingly, it is an object of the present invention to provide an improved mailing machine that addresses those issues described above. In accomplishing this and other objects there is provided a mailing machine including a base, a registration wall and a stripper blade. The base includes a deck defining a deck plane along which an envelope having an envelope body, an envelope flap and a top edge may be fed in a path of travel. The registration wall is located substantially perpendicular to the deck and parallel to the path of travel and along which the envelope top edge may be aligned during feeding. The stripper blade is located upstream in the path of travel from the deck, the stripper blade including a knife edge that is raised above the deck plane for separating the envelope flap from the envelope body.

Therefore, it should now be apparent that the invention substantially achieves the objects discussed above. Additional objects and advantages of the invention will be set forth in the description that follows, and in part will be obvious from the description, or may be learned by practice of the invention. Moreover, the objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown through out the drawings, like reference numerals designate like or corresponding parts.

DETAILED DESCRIPTION OF THE PREFERRED EMBODIMENTS

Figure 1:
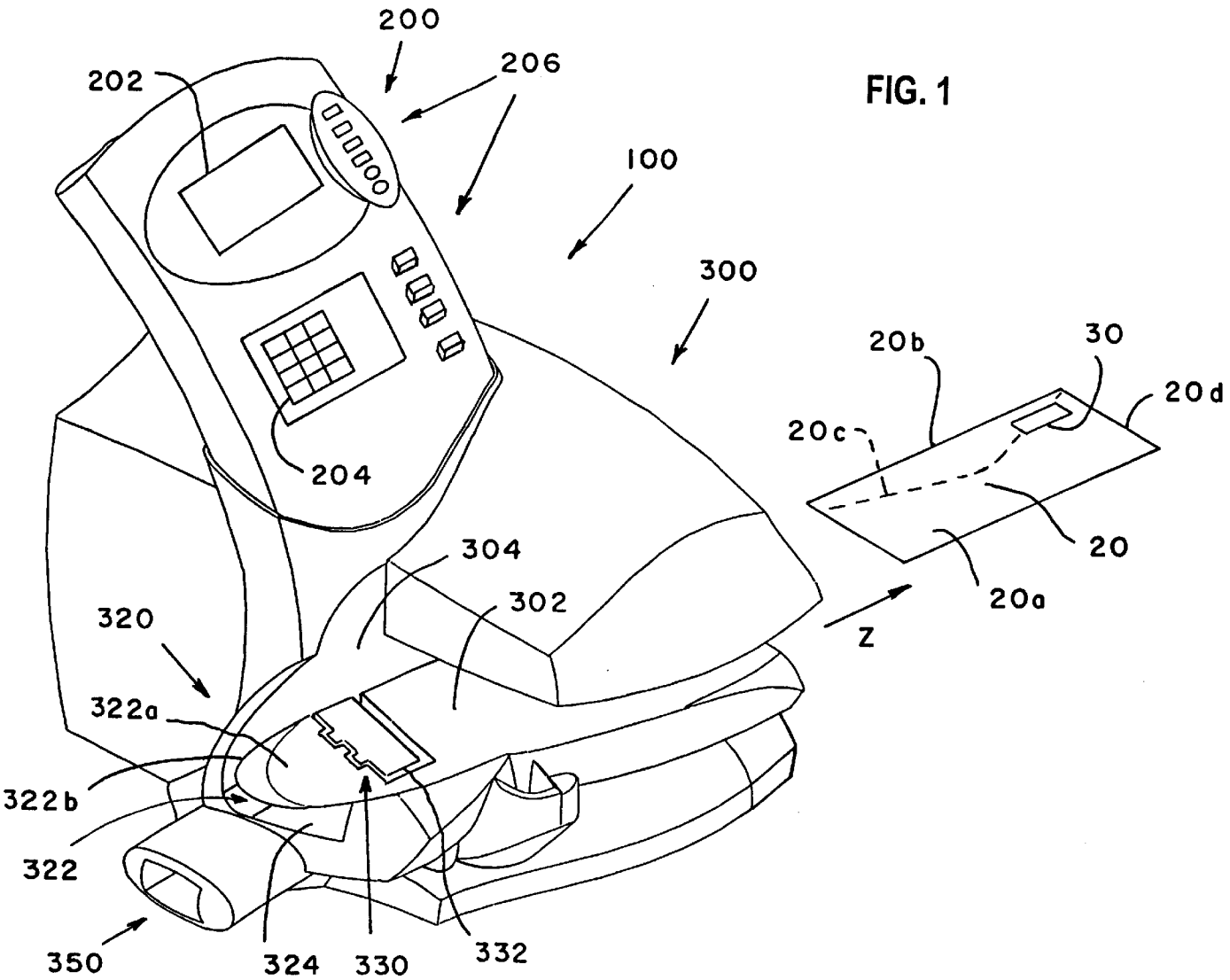
FIG. 1 is an upper-front-left perspective view of a mailing machine including a moistener assembly in accordance with the present invention.
Figure 2:
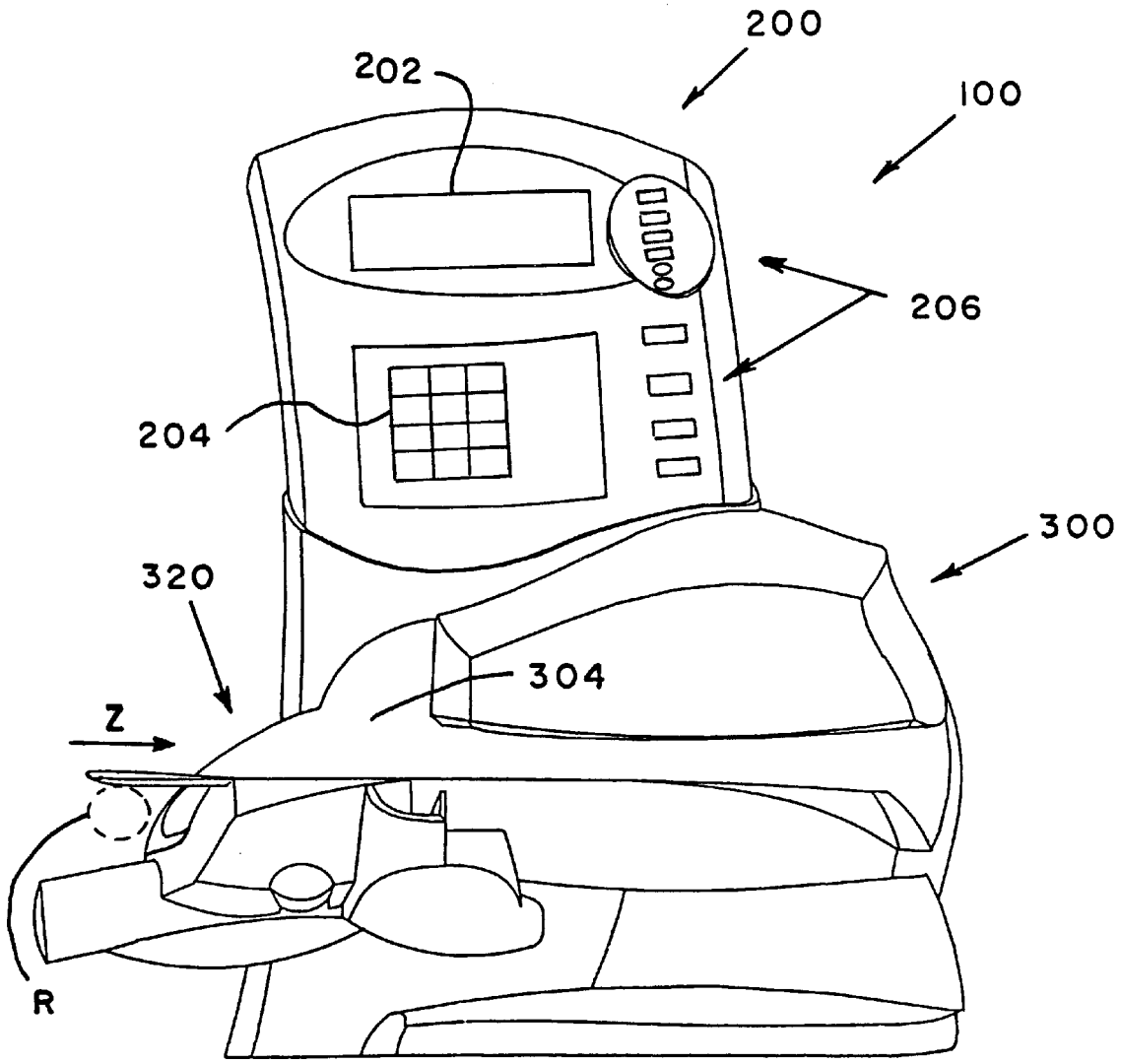
FIG. 2 is a front view of a mailing machine in accordance with the present invention.
Figure 3:
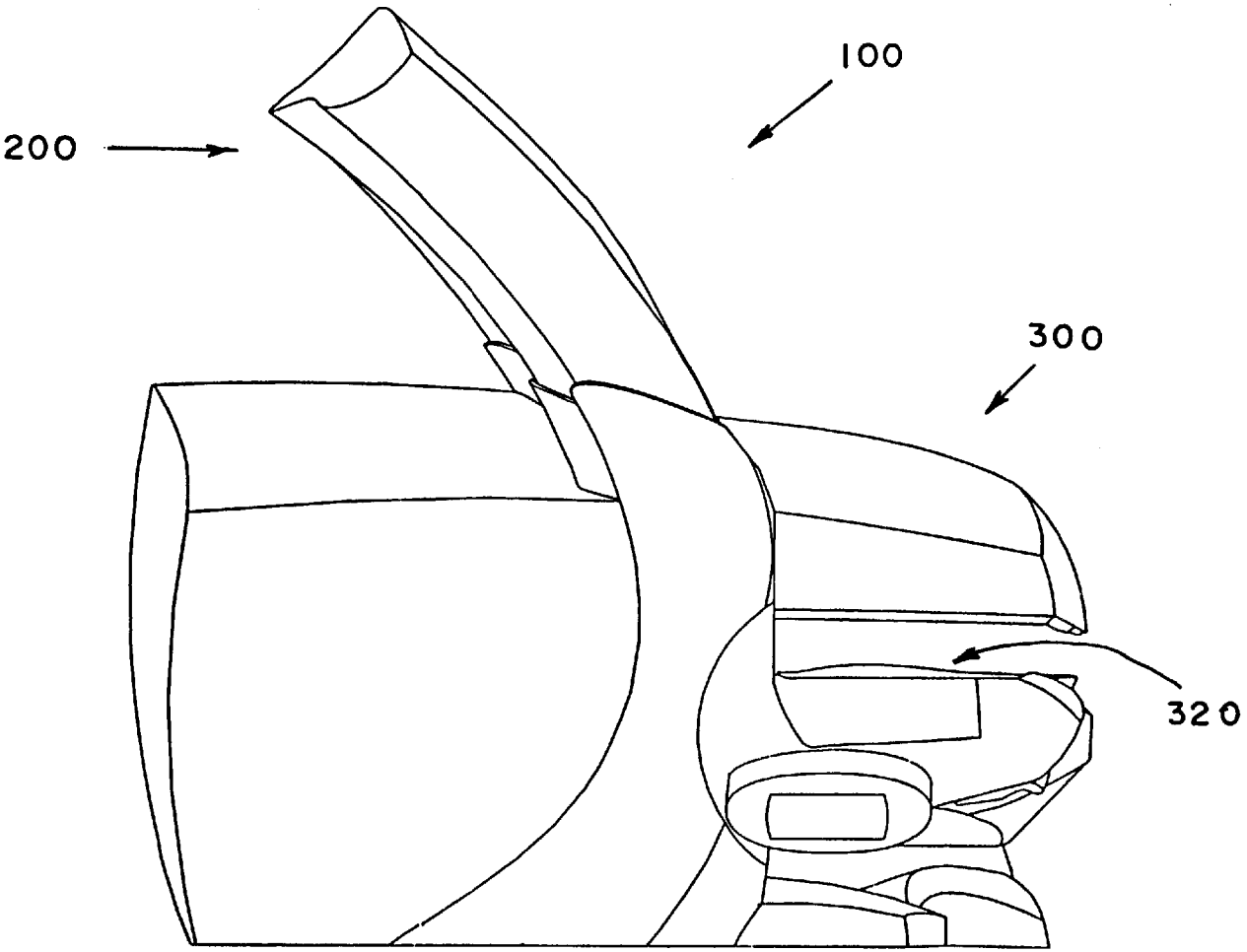
FIG. 3 is a left side view of a mailing machine in accordance with the present invention.

Referring to FIGS. 1, 2 and 3, a mailing machine 100 for processing an envelope 20 is shown. The mailing machine 100 includes a user interface module 200, a base 300 and a printer module (not shown). The user interface 200 includes a suitable display 202, numeric key pay 204 and function keys 206. The user interface is detachably mounted to the base 300 in any conventional manner. The base 300 includes a deck 302, a registration wall 304 (sometimes referred to as a fence) located substantially perpendicular to the deck 304, a moistener assembly 320, a tape input structure 350, a transport apparatus (not shown) for feeding the envelope 20 in a path of travel as indicated by an arrow Z and a printer module (not shown) for printing a postal indicia 30 on the envelope 20. The envelope 20 includes a body 20*a,* a top edge 20*b,* a flap 20*c* and a lead edge 20*d.*

For the sake of clarity and brevity, only those aspects of the mailing machine 100 that are necessary for an understanding of the present invention will be described. However, a more detailed description of the mailing machine 100 is provided in U.S. patent application No. 09/294,606, entitled POSTAGE METERING SYSTEM HAVING MULTIPLE POSTAGE METER CONFIGURATION CAPABILITY, filed on Jun. 7, 1999, and U.S. patent application No. 09/327,078 entitled METHOD AND DEVICE FOR IMPROVING THE EFFICIENCY OF A POSTAGE METER, the disclosures of which are specifically incorporated herein by reference.

Figure 4:
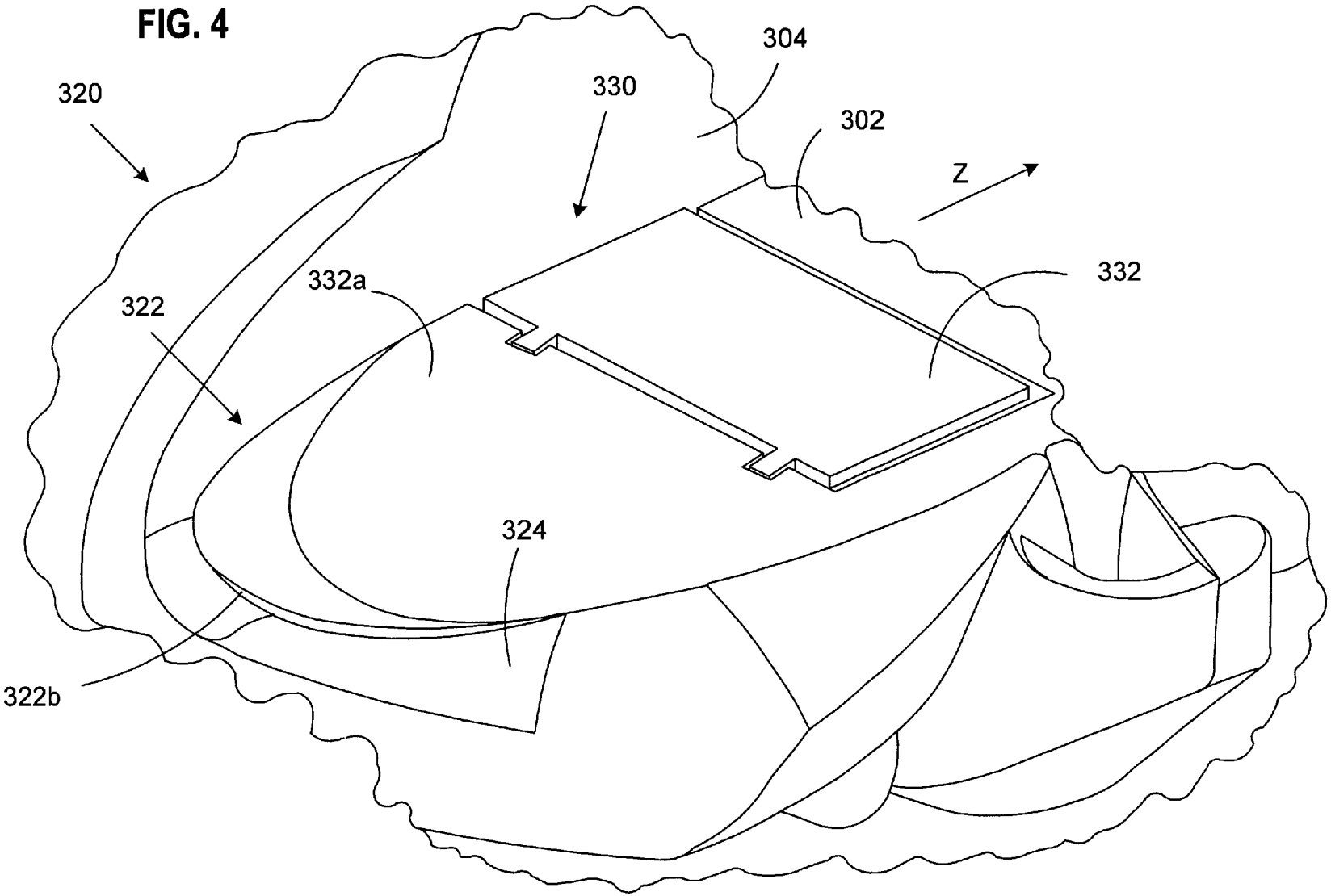
FIG. 4 is an enlarged cut away view of the mailing machine in the moistener assembly area taken from the same vantage point as FIG. 1 in accordance with the present invention.
Figure 5A:
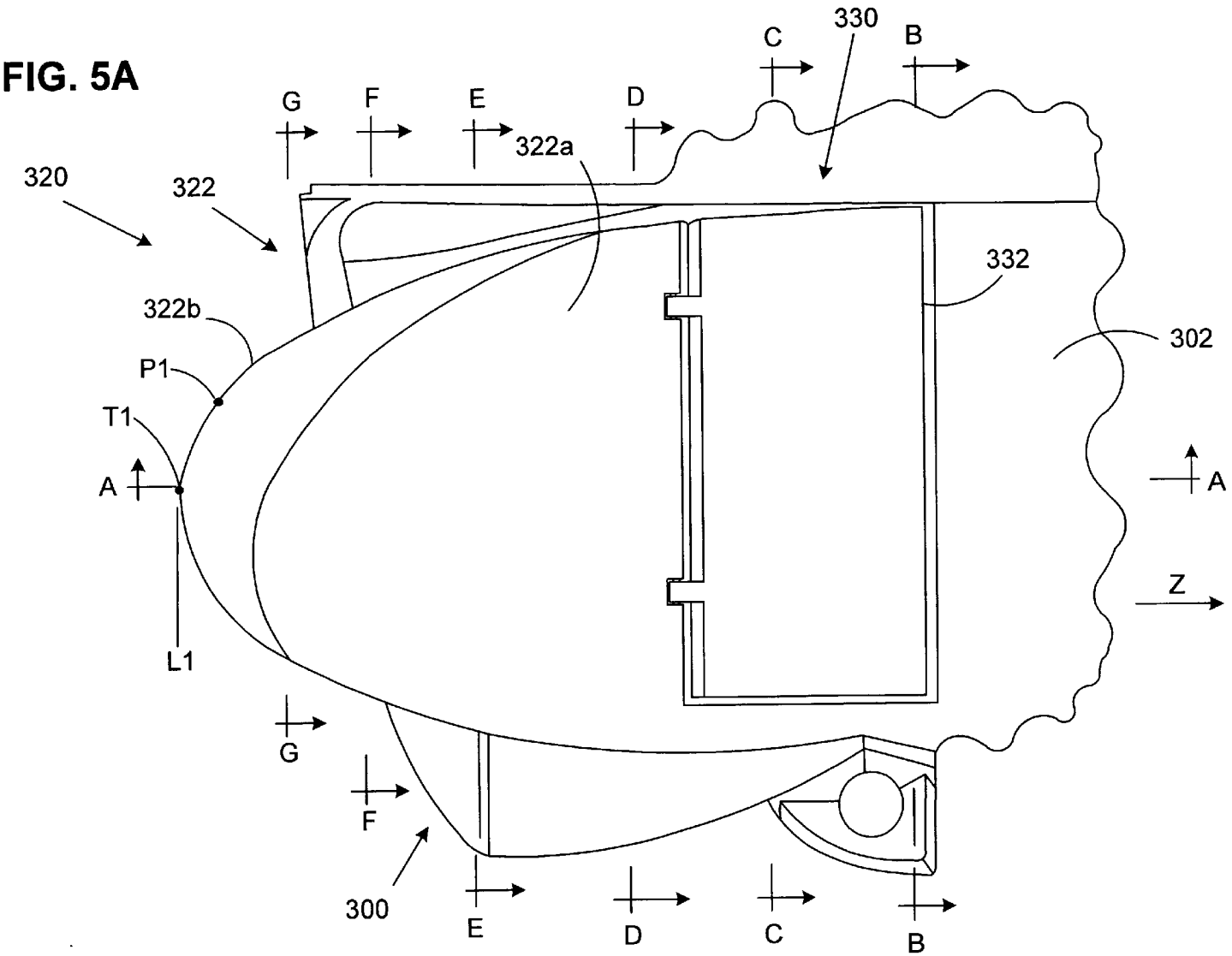
FIG. 5A is an enlarged cut away top view of the mailing machine in the moistener assembly area in accordance with the present invention.

Referring to FIGS. 4 and 5A in view of FIG. 1, enlarged views of the moistener assembly 320 are shown. The moistener assembly 320 includes a stripper blade 322, a guide surface 324 and a wick assembly 330. The stripper blade 322 includes a main body 322*a* and a knife edge 322*b.* The main body 322*a* is substantially coplanar with the deck 302 so as to provide an integral surface for the envelope body 20*a* to rest on. The knife edge 322*b* is raised above the plane of the deck 302 and assists in separating the flap 20*c* from the body 20*a* of the envelope 20.

Figure 6:
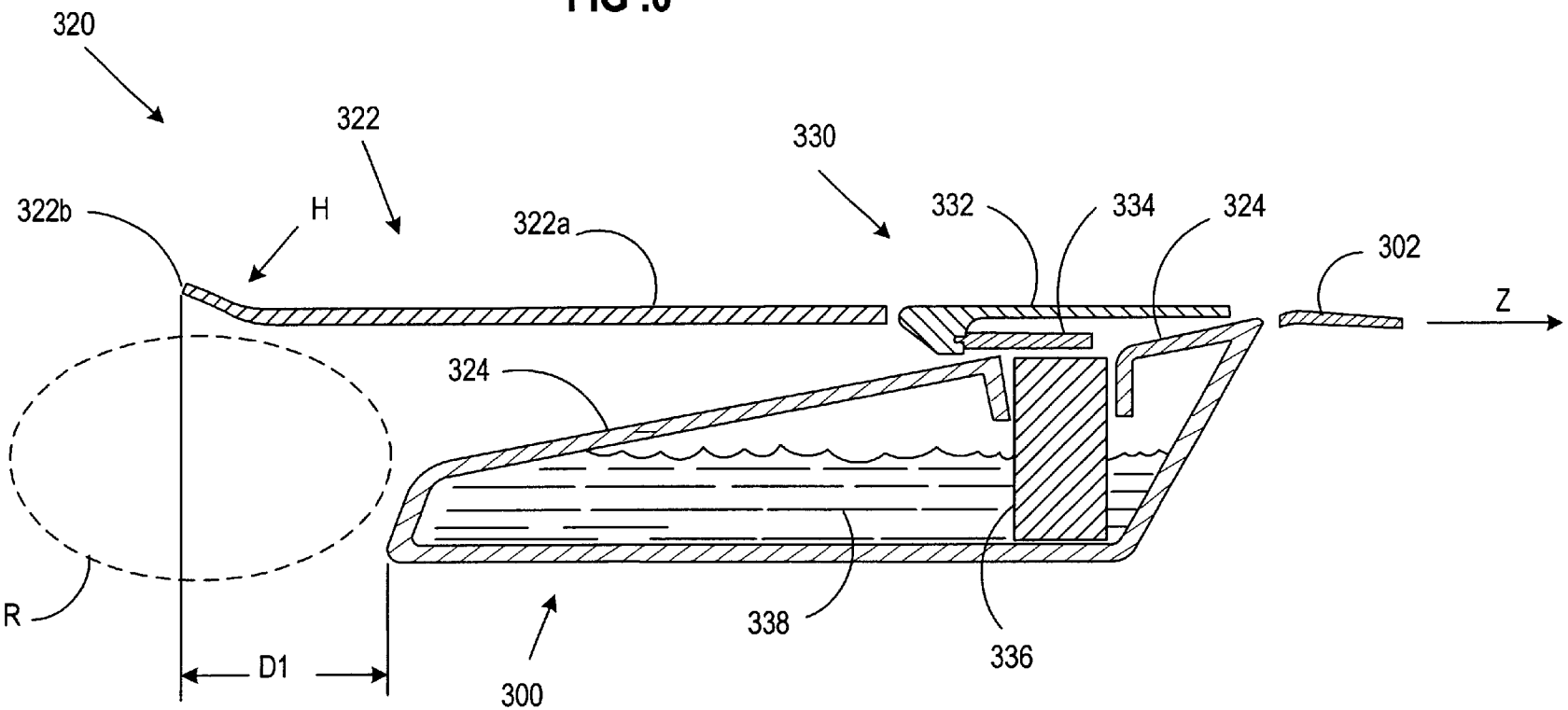
FIG. 6 is a front sectional view of the mailing machine, as defined by line A—A as shown in FIG. 5A, in accordance with the present invention.

Referring to primarily to FIG. 6 in view of FIGS. 1, 4 and 5A, a front sectional view of the moistener assembly 320 is shown. Generally, the front sectional view is taken in a plane parallel to the path of travel. The wick assembly 330 includes a cover 332, a brush 334, a wick 336 and a reservoir 338 of water. The guide surface 324 directs the envelope flap 20*c* toward the wick assembly 330 as the envelope 20 is fed downstream in the path of travel and then back into contact with the envelope body 20*a.* Generally, the wick 336 brings water from the reservoir 338 to the brush 334 via capillary action and the brush 334 applies water to the envelope flap 20*c.* The cover 332 is privotably mounted to the deck 302 in any conventional fashion and in turn removably holds the brush 334. Since the details of the wick assembly 330 are not necessary for any understanding of the present invention, only an overview has been provided.

Figure 7:
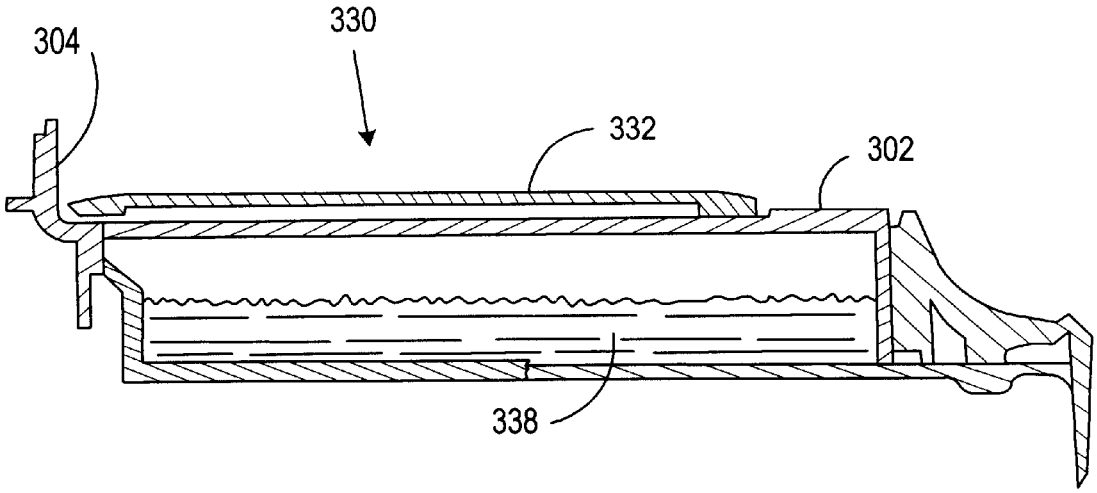
FIG. 7 is a side sectional view of the mailing machine, as defined by the line B—B as shown in FIG. 5A, in accordance with the present invention.
Figure 8:
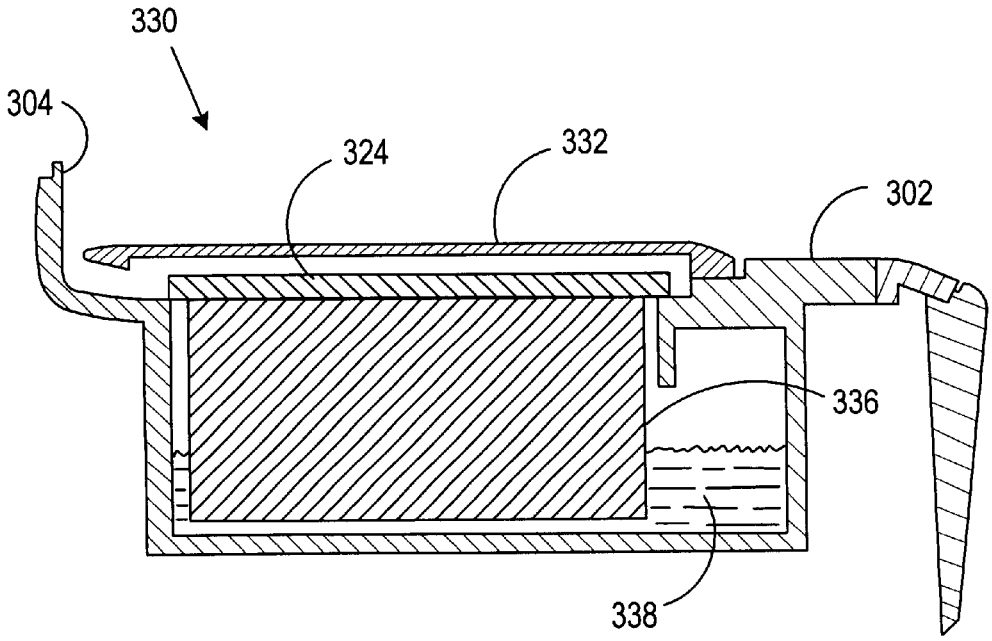
FIG. 8 is a side sectional view of the mailing machine, as defined by the line C—C as shown in FIG. 5A, in accordance with the present invention.
Figure 9:
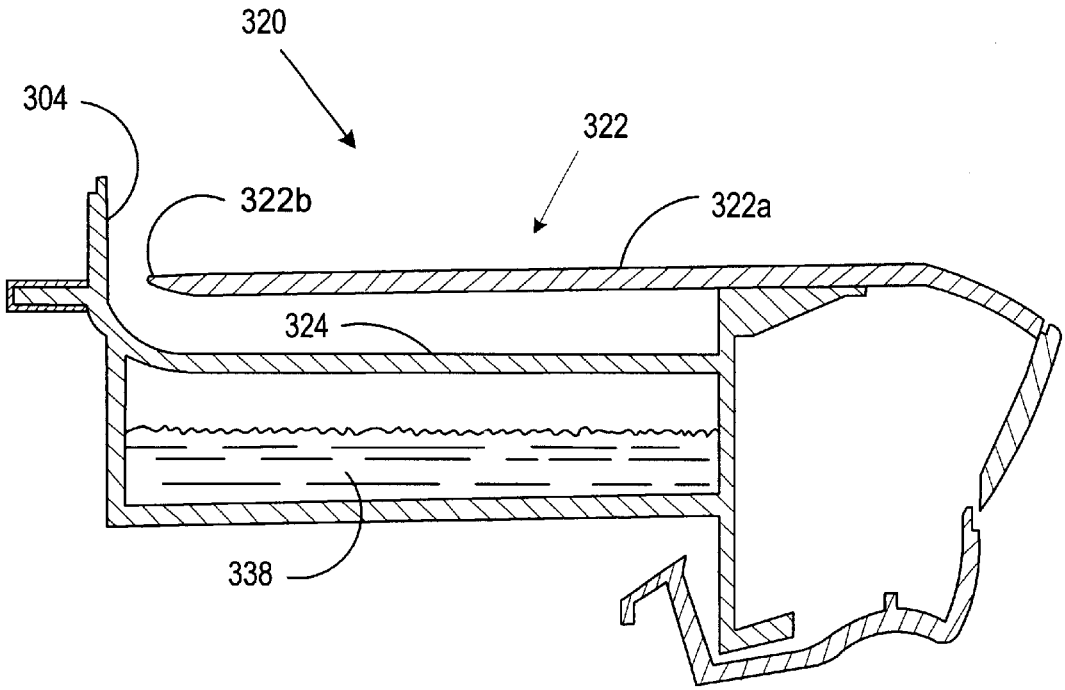
FIG. 9 is a side sectional view of the mailing machine, as defined by the line D—D as shown in FIG. 5A, in accordance with the present invention.
Figure 10:
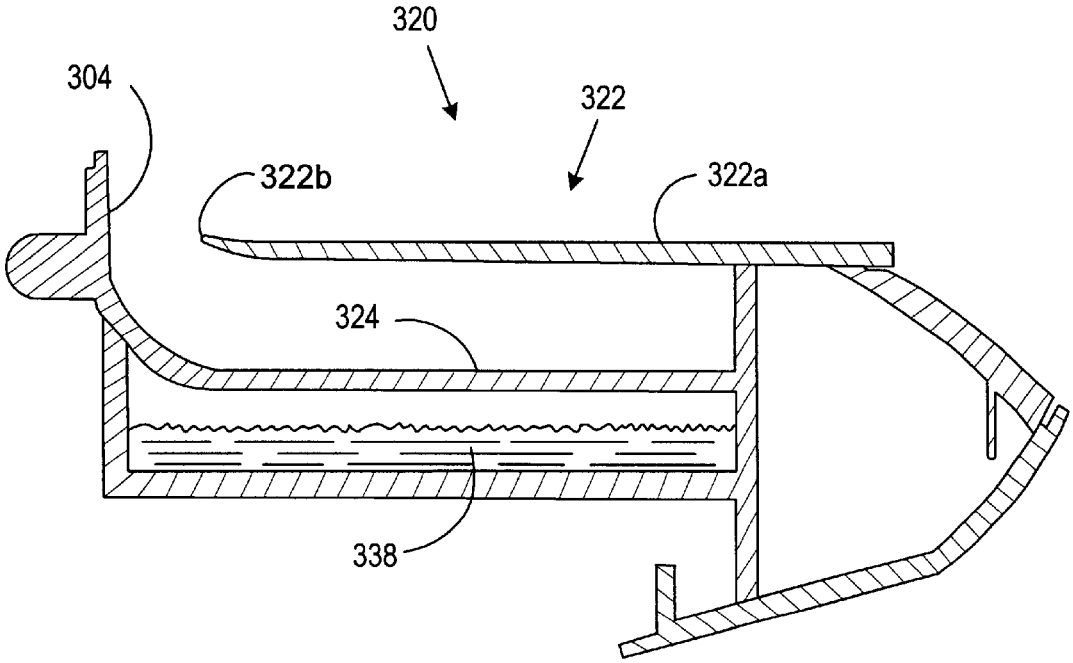
FIG. 10 is a side sectional view of the mailing machine, as defined by the line E—E as shown in FIG. 5A, in accordance with the present invention.
Figure 11:
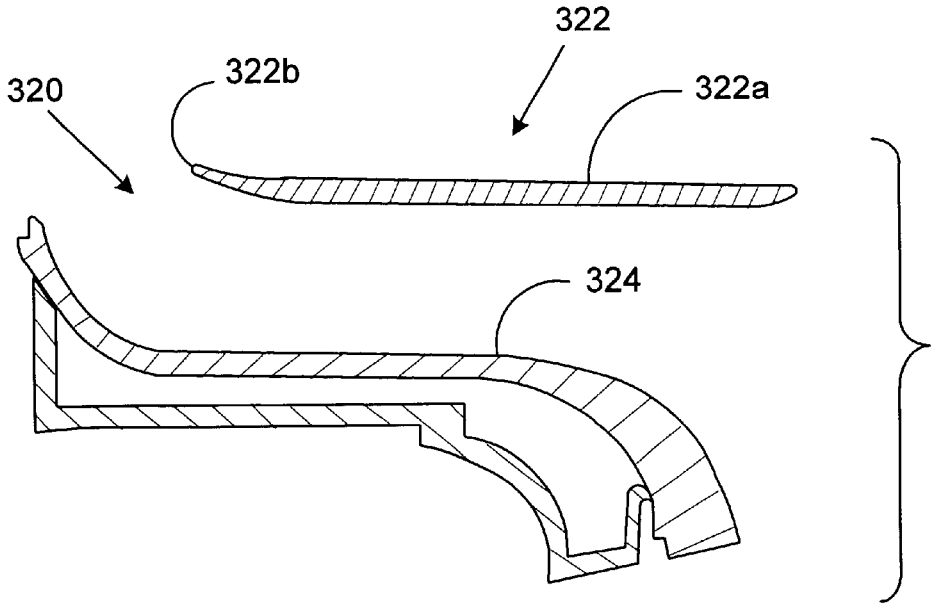
FIG. 11 is a side sectional view of the mailing machine, as defined by the line F—F as shown in FIG. 5A, in accordance with the present invention.
Figure 12:
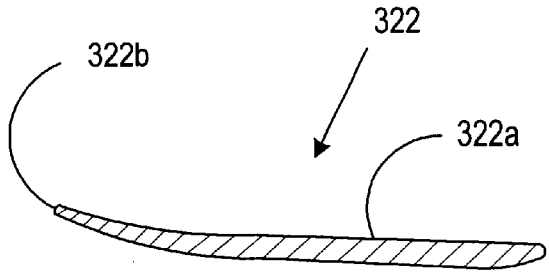
FIG. 12 is a side sectional view of the mailing machine, as defined by the line G—G as shown in FIG. 5A, in accordance with the present invention.

Referring to FIGS. 7–12 in view of FIGS. 1, 4 and 5A, a plurality of left side sectional views of the moistener assembly 320 are shown. Generally, the plurality of left side sectional views are taken in a plane perpendicular to the path of travel and are spaced out along the path of travel. FIGS. 7 and 8 are generally taken through the wick assembly 330 while FIGS. 9–12 are generally taken through the stripper blade 322.

Figure 5B:
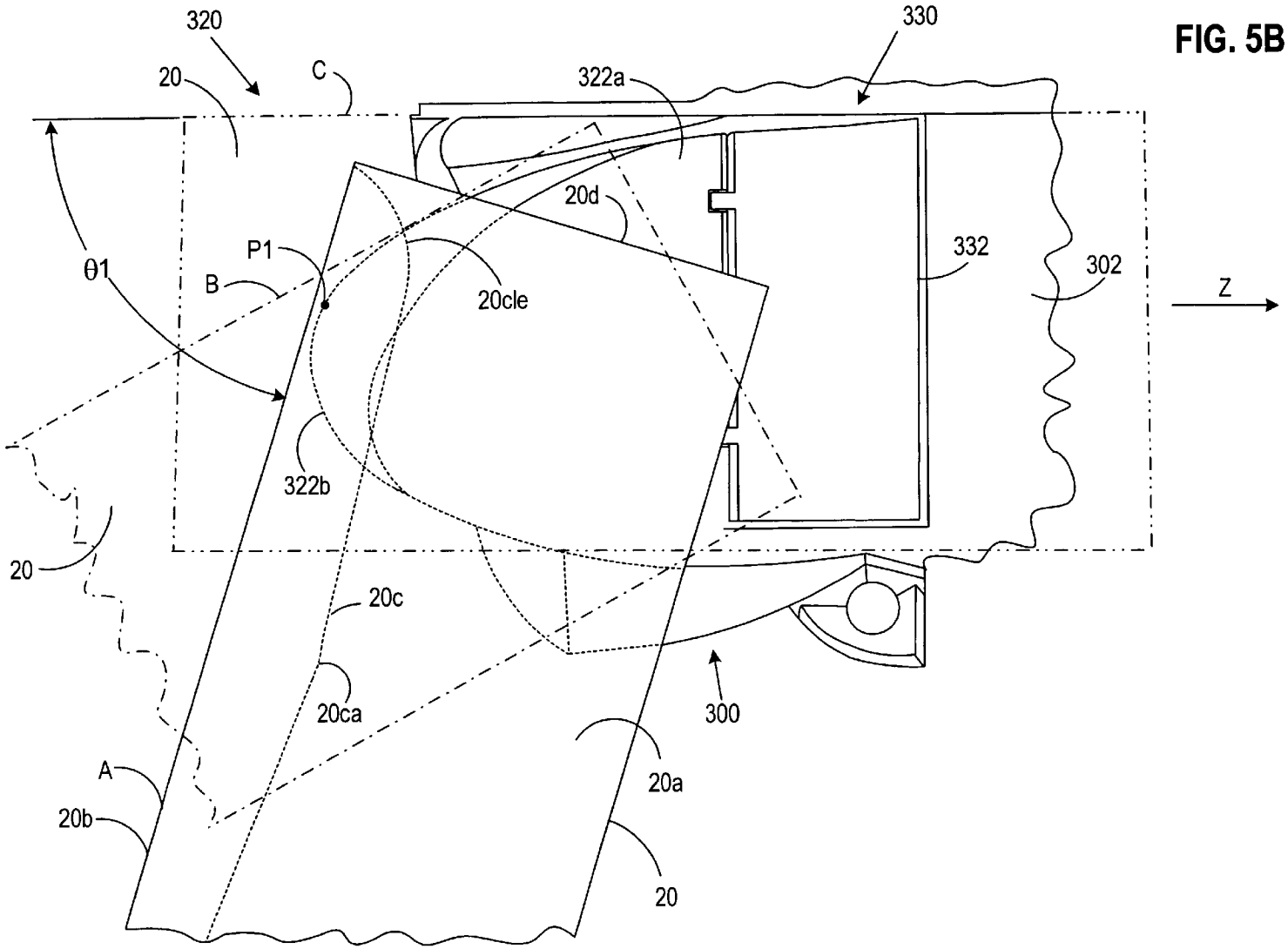
FIG. 5B is an enlarged cut away top view of the mailing machine in the moistener assembly area and an envelope shown in several positions during the feeding process in accordance with the present invention.

With the structural aspects of the present invention described as above, various operational aspects will now be described. For the sake of clarity and brevity, it is assumed that the operator chooses to moisten and seal the envelope 20 during the postage metering process. Referring primarily to FIG. 5B, in view of the structure of FIGS. 1–4, 5A and 6–12, the envelope 20 is shown in a plurality of positions A, B and C during feeding. In position A, the envelope 20 is shown in solid lines, while in positions B and C only an outline of the envelope 20 in dashed lines is shown. Generally, these positions are prior to the transport apparatus (not shown) taking control of the envelope 20.

In position A, the operator has placed the envelope 20 so that the envelope lead edge 20*d* is resting primarily on the stripper blade body 322*a* and the stripper blade knife edge 322*b* is between the envelope flap 20*c* and the envelope body 20*a*. Since the order of these actions is not critical, the operator may rest the envelope lead edge 20*d* and then separate the envelope flap 20*c* or vice versa. Also, exactly where along the stripper blade knife edge 322*b* the envelope 20 makes first contact is not critical. Thus, the envelope 20 may assume a variety of different angels with respect to the registration wall 304.

In position B, the operator has advanced the envelope 20 along the stripper blade knife edge 322*b* toward the registration wall 304 and the envelope top edge 20*b* is beginning to come into alignment with the registration wall 304 due to the shape of the stripper blade knife edge 322*b*. However, the envelope flap 20*c* is not yet engaging the wick assembly 330.

In position C, the operator has continued to advance the envelope 20 along the stripper blade knife edge 322*b* so that the envelope top edge 20*b* is in alignment with the registration wall 304. Here, a portion of the envelope flap 20*c* has been moistened. This is approximately the position when the transport apparatus (not shown) would take over control of the envelope 20 and seal the envelope flap 20*c* to the envelope body 20*a*.

With the structural and operational aspects of the present invention described as above, various dimensional aspects will now be described. Referring to FIGS. 5A, 5B and 6, the stripper blade knife edge 322*b* gradually raises above the plane of the deck 302 and reaches a maximum height above the plane of the deck 302 at approximately a point P1. Preferably, this maximum height is at least approximately 0.125 inches. In the most preferred embodiment, the maximum height is 0.200 inches. Empirical testing has revealed that this raised portion of the knife edge 322*b* provides a visual clue to the operator as to where to "land" the envelope 20 and promotes easier stripping of the envelope flap 20*c* because the stripper blade knife edge 322*b* is more prominent. Also, a slight hollow H is created between the stripper blade knife edge 322*b* and the stripper blade body 322*a* that facilitates the envelope body 20*a* temporarily taking on a curved shape that assists in separating the envelope flap 20*c* from the envelope body 20*a* thus making it easier to "catch" the stripper blade knife edge 322*b* therebetween.

The stripper blade knife edge 322*b* is oval shaped and oriented so that a line L1 perpendicular to the path of travel may be drawn tangent to the stripper blade knife edge 322*b* at a tip T1 of the stripper blade knife edge 322*b*. This also facilitates proper stripping of the envelope flap 20*c* because the operator may simply "catch" the stripper blade knife edge 322*b* between the envelope flap 20*c* and the envelope body 20*a* before having to be concerned with the orientation of the envelope 20 to the registration wall 304. As a result, less dexterity on the part of the operation is required over the prior art systems discussed above.

However, it is not necessary that the shape of the stripper blade knife edge 322*b* allows this vertical tangent so long as the arc of the stripper blade knife edge 322*b* is sufficient to allow the envelope top edge 20*b* to form an angle θ1 with the registration wall 304. Empirical testing has revealed that it is important to allow the operator ample opportunity to strip the envelope flap 20*c* before aligning the envelope top edge 20*b* with the registration wall 304. Preferably, the angle θ1 is at least approximately thirty (30) degrees. In the most preferred embodiment, the angle θ1 is sixty (60) degrees. Generally, a less skilled operator more likely to commence feeding the envelope 20 in the sixty (60) degree range while a more skilled operator is more likely to commence feeding the envelope 20 in the thirty (30) degree range or less.

Referring to FIGS. 2, 5A, 5B and 6, the stripper blade knife edge 322*b* overhangs the base 300 and particularly the guide surface 324, by extending sufficiently upstream in the path of travel, so that a large unobstructed region R underneath the stripper blade knife edge 322*b* is formed. Empirical testing has revealed that feature also provides a visual clue to the operator as to where to "land" the envelope 20 and promotes easier stripping of the envelope flap 20*c* because the stripper blade knife edge 322*b* is prominently and readily accessible. Preferably, a dimension D1 as defined by a distance in the path of travel from the tip T1 to the base 300 is at least approximately 0.500 inches. In the most preferred embodiment, the dimension D1 is 1.000 inches.

With reference to FIGS. 1–12, it will now be apparent to those skilled in the art that the present invention requires less dexterity and precision on the part of the operator to properly strip the envelope flap 20*c* from the envelope body 20*a*. The tip T1 of the stripper blade knife edge 322*b* is so prominently positioned that the operator may easily place the stripper blade knife edge 322*b* between an apex 20cp of the envelope flap 20*c* and the envelope body 20*a* without concern as to the orientation of the envelope 20 to the registration wall 304. Then, as the operator rocks the envelope 20*c* around the arc of the stripper blade knife edge 322*b*, the stripper blade knife edge 322*b* automatically strips a lead edge 20cle of the envelope flap 20*c* while the envelope top edge 20*b* is brought into substantial alignment with the registration wall. Thus, the present invention simplifies the actions required of the operator while semi-automating the stripping of the entire flap 20*c*.

Those skilled in the art will recognize that modifications to the preferred embodiment may be made without departing from the spirit of the present invention. For example, the exact arc-type shape of the stripper blade knife edge 322*b* is not material so long as the characteristics described above are preserved. Still further, those skilled in the art will recognize that the features described above are largely independent and may be employed in a variety of combinations depending upon the needs of the particular application.

Therefore, the inventive concepts in their broader aspects are not limited to the specific details of the preferred embodiment but are defined by the appended claims and their equivalents.

What is claimed is:

1. A mailing machine comprising:

a base including a deck defining a deck plane along which an envelope having an envelope body, an envelope flap and a top edge may be fed in a path of travel;

a registration wall located substantially perpendicular to the deck and parallel to the path of travel and along which the envelope top edge may be aligned during feeding; and a stripper blade located upstream in the path of travel from the deck, the stripper blade including a main body that is coplanar with the deck plane and a knife edge that transitions from the main body away from the deck plane to a position that is raised above the deck plane for separating the envelope flap from the envelope body; and wherein:

the envelope flap may be separated from the envelope body by the stripper blade before the envelope top edge is aligned with the registration wall.

2. The mailing machine of claim 1, wherein:

the knife edge includes a tip extending upstream in the path of travel from the main body so that the knife edge tip overhangs the base and creates an unobstructed region underneath and upstream in the path of travel from the knife edge tip.

3. The mailing machine of claim 2, wherein:

the knife edge is arc shaped so that a line drawn tangent to the knife edge forms an angle of at least 30 degrees with the registration wall.

4. The mailing machine of claim 3, wherein:

the knife edge is further arc shaped so that another line substantially perpendicular to the registration wall may be drawn tangent to the knife edge;

the knife edge raises at least 0.125 inches above the deck plane; and a dimension in the unobstructed region as defined by a distance in the path of travel from the knife edge tip to the base is at least 0.500 inches.

5. A mailing machine comprising:

a base including a deck defining a deck plane along which an envelope having an envelope body, an envelope flap and a top edge may be fed in a path of travel;

a registration wall located substantially perpendicular to the deck and parallel to the path of travel and along which the envelope top edge may be aligned during feeding;

a stripper blade located upstream in the path of travel from the deck, the stripper blade including a main body and a knife edge for separating the envelope flap from the envelope body, the knife edge including a tip extending upstream in the path of travel from the main body so that the knife edge tip overhangs the base and creates an unobstructed region underneath and upstream in the path of travel from the knife edge tip.

6. The mailing machine of claim 5, wherein:

the knife edge is arc shaped so that a line drawn tangent to the knife edge forms an angle of at least 30 degrees with the registration wall; and the envelope flap may be separated from the envelope body by the stripper blade before the envelope top edge is aligned with the registration wall.

7. The mailing machine of claim 6, wherein:

the knife edge transitions from the main body away from the deck plane to a position that is raised above the deck plane.

8. The mailing machine of claim 7, wherein:

the knife edge is further arc shaped so that another line substantially perpendicular to the registration wall may be drawn tangent to the knife edge;

the knife edge raises at least 0.125 inches above the deck plane; and a dimension in the unobstructed region as defined by a distance in the path of travel from the knife edge tip to the base is at least 0.500 inches.

* * * * *